US005600423A

United States Patent [19]

Miyashiro et al.

[11] Patent Number: 5,600,423

[45] Date of Patent: Feb. 4, 1997

[54] IMAGE FORMING APPARATUS INCLUDING A TRANSFER MEDIUM BEARING MEMBER HAVING A SHEET MEMBER FOR BEARING A TRANSFER MEDIUM THEREON

[75] Inventors: Toshiaki Miyashiro, Ichikawa; Akihiko Takeuchi, Yokohama; Toshihiko Ochiai, Tokyo; Motoi Kato, Yokohama; Akira Ito, Tokyo; Nobuaki Kabeya, Toride; Takehiko Suzuki; Takao Kume, both of Yokohama, all of Japan

[73] Assignee: Canon Kabushiki Kaisha, Tokyo, Japan

[21] Appl. No.: 426,836

[22] Filed: Apr. 24, 1995

[30] Foreign Application Priority Data

Apr. 28, 1994 [JP] Japan ..... 6-113672

[51] Int. Cl.[6] ..... G03G 15/16

[52] U.S. Cl. ..... 399/313; 399/298

[58] Field of Search ..... 355/271, 273, 355/274, 327, 326 R; 118/645

[56] References Cited

U.S. PATENT DOCUMENTS 5,038,178 8/1991 Hosoya et al. ..... 355/271 X 5,235,386 8/1993 Yano et al. ..... 355/219

5,307,127 4/1994 Kobayashi et al. ..... 355/259

5,321,482 6/1994 Yano et al. ..... 355/299

5,390,012 2/1995 Miyashiro et al. ..... 355/273

5,402,218 3/1995 Miyashiro et al. ..... 355/274

*Primary Examiner*—William J. Royer

*Attorney, Agent, or Firm*—Fitzpatrick, Cella, Harper & Scinto

[57] ABSTRACT

An image forming apparatus has an image bearing member bearing images thereon and movable, and a transfer medium bearing member provided in pressure contact with the image bearing member and bearing a transfer medium thereon and rotatable. The transfer medium bearing member has a sheet member for bearing the transfer medium thereon, and an elastic layer supporting that area of the sheet member bearing the transfer medium thereon from the inside of the sheet member. A voltage is applied to the transfer medium bearing member to transfer the images on the image bearing member to the transfer medium born on the sheet member. The sheet member has an area not fixed to the elastic layer. The transfer medium bearing member is rotated with a potential difference created between the image bearing member and the sheet member before the operation of transferring the images on the image bearing member to the transfer medium born on the sheet member is started.

76 Claims, 11 Drawing Sheets

IMAGE FORMING APPARATUS INCLUDING A TRANSFER MEDIUM BEARING MEMBER HAVING A SHEET MEMBER FOR BEARING A TRANSFER MEDIUM THEREON

BACKGROUND OF THE INVENTION

1. Field of the Invention

This invention relates to an image forming apparatus for transferring images on an image bearing member to a transfer medium born on a transfer medium bearing member to thereby form an image.

2. Related Background Art

The electrophotographic electrostatic recording system has often been used in color image forming apparatuses. As shown in FIG. 9 of the accompanying drawings, a color image forming apparatus is provided with an image bearing member 2 having a photosensitive medium on the surface thereof, an initial charger 16 for uniformly charging the image bearing member 2, an exposure device 13 having a light source such as a laser and transmitting a light signal and writing an electrostatic latent image onto the image bearing member 2, a developing device 6 containing therein color developers such as yellow (Y), magenta (M), cyan (C) and black (K) developers and developing the electrostatic latent image formed on the image bearing member 2 to thereby visualize it as a toner image, a transfer member 101 for holding a supplied transfer medium 14 by electrostatic absorption and by a gripper 11, repetitively conveying it to a transfer station opposed to the image bearing member 2 and transferring the toner image of each color formed on the image bearing member 2 onto the transfer medium 14, a cleaner 12 for removing any developer remaining on the image bearing member 2 after the transfer of the toner image of each color, and a fixating device 9 for fixating the toner image transferred onto the transfer medium 14.

The transfer member 101, as shown in FIG. 10A of the accompanying drawings, assumes a construction in which only a portion of the outer peripheral surface of a hollow drum housing 101*c* is left and the other transfer area is cut away and a flexible sheet 101*a* of a thickness of 30 to 250 μm typified by polyethylene terephthalate (PET), polyvinylidene fluoride (PVdF), ethylene fluoride propylene copolymer (FEP), polycarbonate, polyuethane or the like is extended over the cut-away portion.

Inside and outside the transfer member 101, along the direction of rotation thereof, there is disposed an absorption roller 3 for electrostatically absorbing the transfer medium 14 onto the flexible sheet 101*a*, an absorption charger 5 opposed thereto with the flexible sheet 101*a* interposed therebetween, a transfer charger 4 for causing the toner image formed on the image bearing member 2 to be transferred onto the transfer medium 14, a separation charger 7 for separating the transfer medium 14 electrostatically absorbed onto the flexible sheet 101*a* therefrom, a separation pawl 15 which is an auxiliary separation means, and sheet electricity removal chargers 8 for initializing the potential of the flexible sheet 101*a*.

The image forming process of the above-described color image forming apparatus will now be described. The image bearing member 2 is first charged by an initial charger 16, and then the image bearing member 2 is exposed by a light signal based on an image signal of a first color, e.g. a magenta component color, from the exposure device 13 to thereby form an electrostatic latent image, which is developed by the developing device 6 containing the magenta developer therein, and is visualized as a magenta toner image. In parallel with this developing step, the supplied transfer medium 14 is rotated and twined on the transfer member 101 with its leading end gripped by the gripper 11 and the absorption roller 3 bears against the transfer medium 14 and nips it between itself and the surface of the transfer member 101. The transfer medium 14 is then electrostatically absorbed onto the surface of the transfer member 101 by charges imparted to the back of the flexible sheet 101*a* by the absorption charger 5, and the transfer medium 14 is held on the transfer member 101. The transfer medium 14 thus held on the transfer member 101 is conveyed to the transfer station opposed to the image bearing member 2 with the rotation of the transfer member 101, and the toner image formed on the image bearing member 2 is transferred onto the transfer medium 14 by the transfer charger 4 disposed in opposed relationship with the image bearing member 2.

After the termination of this transferring step of the first color, if the image bearing member 2 has any developer remaining thereon, the developer is removed by the cleaner 12 and an electrostatic latent image is again formed based on an image signal of a second color by charging and exposure, and the latent image is developed by the developing device 6 containing a developer of the second color, e.g. cyan, therein and is visualized as a cyan toner image. This cyan toner image is superposed on the magenta toner image and transferred onto the transfer medium 14 on the transfer member 101 onto which the magenta toner image has been previously transferred. Steps similar to what has been described above are also effected on third and fourth colors, e.g. yellow and black, whereby on the transfer medium 14, there is formed a color image comprising toner images of four colors superposed one upon another.

After the termination of the transfer of the toner images of four colors, the transfer medium 14 is conveyed to the location at which the inside and outside separation chargers 7 are disposed, by the rotation of the transfer medium 101, and the electrostatic absorption force between the transfer medium 14 and the flexible sheet 101*a* is removed by the separation chargers 7, whereafter the transfer medium 14 is separated from the transfer member 101 through the separation pawl 15. The thus separated transfer medium 14 is directed to the fixating device 9, where the mixing of the toner images of four colors and the fixation thereof onto the transfer medium 14 are effected. After the separation of the transfer medium, the transfer member 101 has its electricity removed by the sheet electricity removal chargers 8 and is electrically initialized, whereafter any developer adhering to the surface of the transfer member 101 are removed by a transfer member cleaner 10.

While in the foregoing, description has been made of the image formation by the color image forming apparatus using the transfer member 101 of the cut-away drum type, it has also been proposed to effect image formation by the use of a transfer member 1 having no cut-away portion as shown in FIG. 10B of the accompanying drawings. This transfer member 1 has its drum housing 1*c* formed into an electrically conductive cylinder free of a cut-away portion, and the drum housing 1*c* is covered with an electrically conductive elastic layer 1*b* formed of an electrically conductive foamed material such as urethane rubber, CR rubber, EPDM rubber or silicone rubber, and a flexible sheet 1*a* similar to the aforedescribed flexible sheet 101*a* is further superposed on the surface of the electrically conductive elastic layer 1*b*, and transfer can be accomplished by transfer bias being applied to the drum housing 1*c*.

The transfer member 1 free of a cut-away portion as described above has the advantage that its interior can be simplified as compared with the transfer member 101 of the cut-away drum type of FIG. 10A and thus the cost thereof can be reduced. In addition, the entire flexible sheet 1*a* is adapted to be supported from the inside thereof and therefore, the deformation and breakage of the flexible sheet 1*a* which are problems peculiar to the cut-away structure of FIG. 10A can be described to thereby extend the service life of the flexible sheet 1*a*. From such a point, attention is now paid to a color image forming apparatus using the transfer member 1 free of a cut-away portion (a transfer member of the bias drum type).

However, when the transfer member 1 of the bias drum type is used and color images are to be continuously formed on a plurality of transfer mediums 14 by an image formation starting signal being inputted once, there has been the tendency that color shift remarkably occurs to the color image formed on the first transfer medium and color shift does not occur to the second and subsequent transfer mediums. Further, there has been seen the tendency that on the first transfer medium, the image of the first color deviates relative to the images of the second, third and fourth colors.

SUMMARY OF THE INVENTION

It is an object of the present invention to provide an image forming apparatus which can transfer an image on an image bearing member to a predetermined location on a transfer medium born on a recording medium carrying member.

It is a further object of the present invention to provide an image forming apparatus which can transfer images superposedly on an image bearing member to a transfer medium born on a recording medium carrying member without shift occurring to the image.

Further objects and features of the present invention will become apparent from the following detailed description of the invention taken in conjunction with the accompanying drawings.

DESCRIPTION OF THE PREFERRED EMBODIMENTS

[Embodiment 1]

Figure 9:
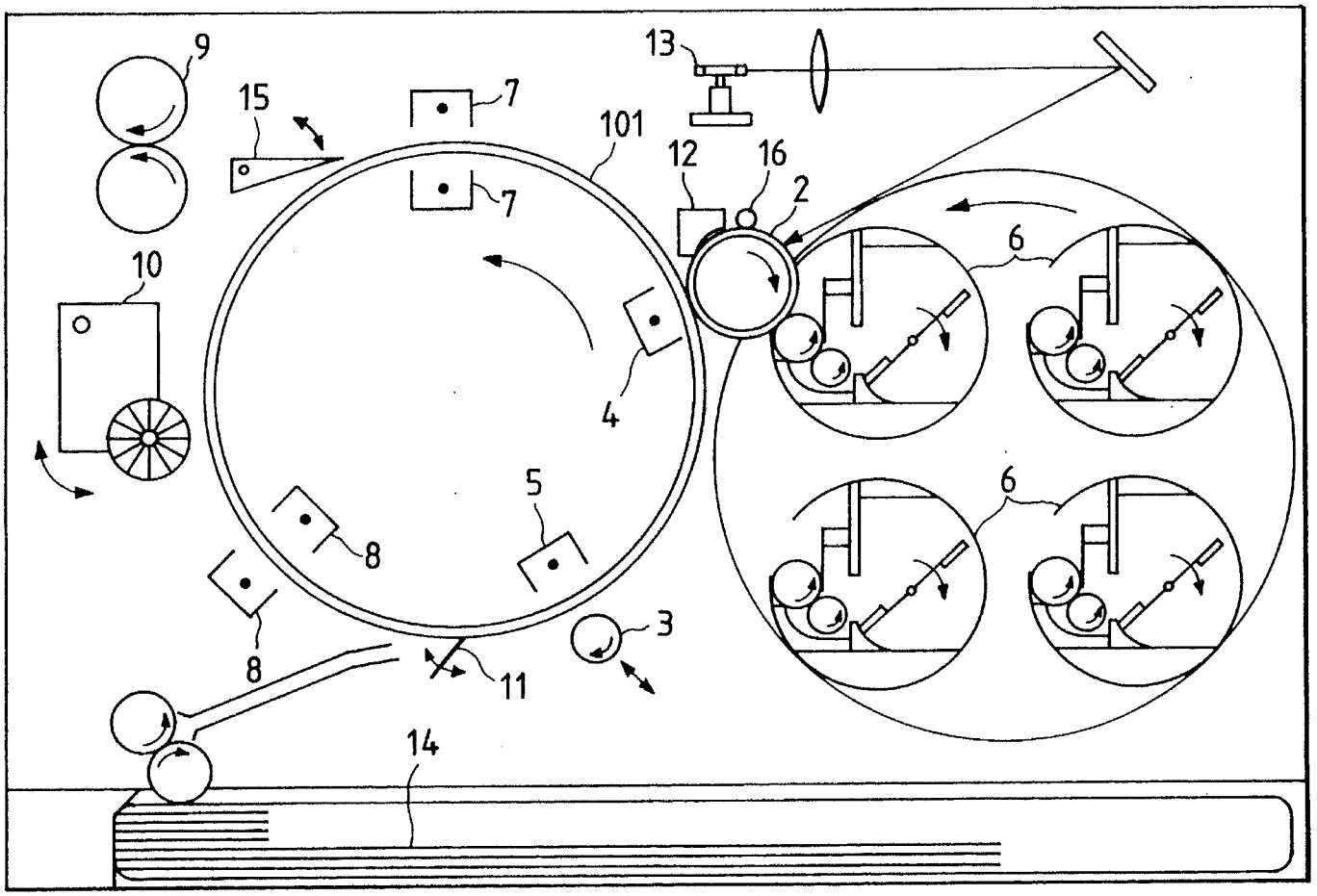
FIG. 9 shows the construction of a color image forming apparatus using a transfer member of the cut-away drum type.

Image formation in an apparatus using a transfer member of the bias drum type in this embodiment will hereinafter be described with reference to FIG. 11, and in FIG. 11, members functionally similar to those shown in FIG. 9 are given the same reference characters and need not be described in detail.

Figure 10A:
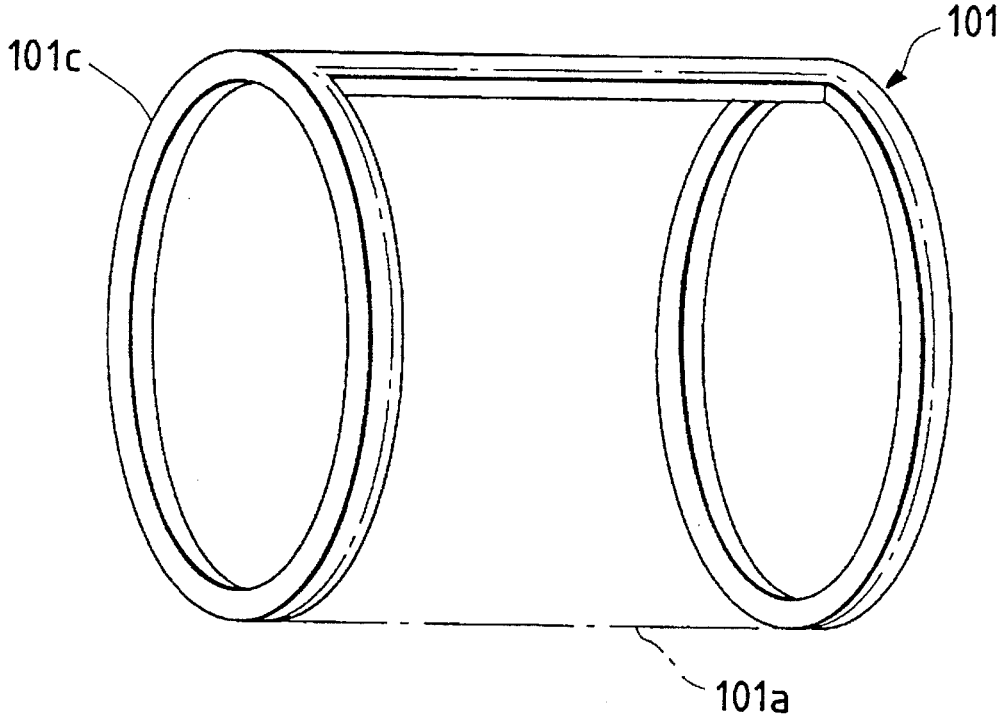
FIGS. 10A and 10B are perspective views showing a transfer member of the cut-away drum type and a transfer member of the bias drum type, respectively.
Figure 10B:
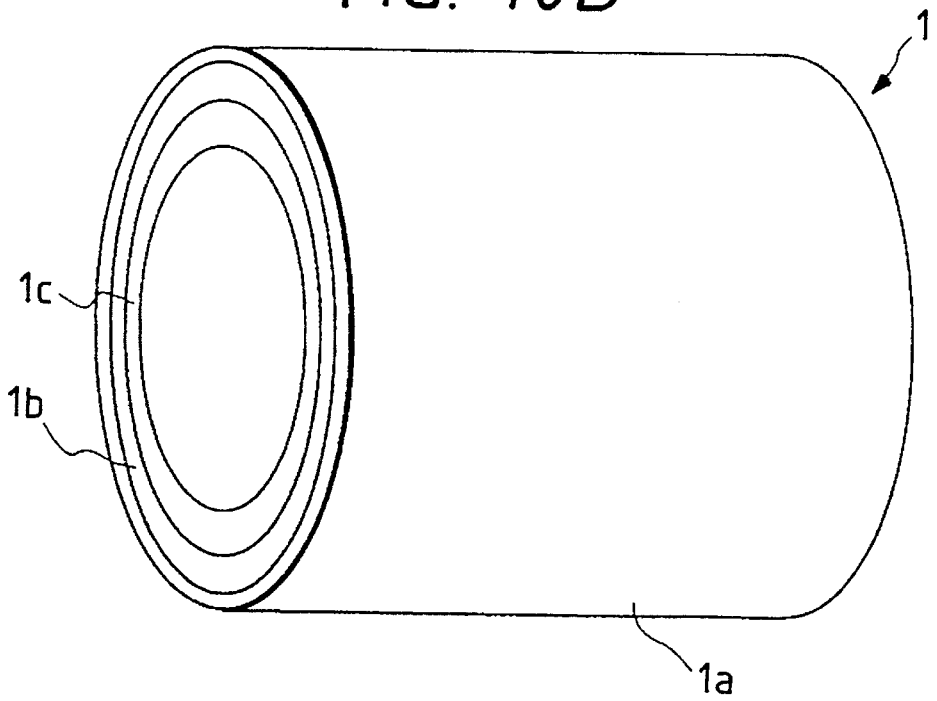

The transfer member 1 in the present embodiment, as shown in FIG. 10B, comprises a drum housing 1*c* formed into an electrically conductive cylinder free of a cut-away portion, and covered with an electrically conductive elastic layer 1*b* formed of an electrically conductive foamed material such as urethane rubber, CR rubber, EPDM rubber or silicone rubber, and a flexible sheet 1*a* as previously described superposed on the surface of the electrically conductive elastic layer 1*b*, and can effect transfer by transfer bias being applied to the drum housing 1*c*.

A transfer medium 14 supplied to the transfer member 1 first has its leading end gripped by a gripper 11 as in the cut-away type, and is twined around the transfer member 1 by the rotation of the transfer member 1. Simultaneously therewith, charges are poured into the transfer medium 14 from an absorption roller 3 to which absorption bias has been applied, and the transfer medium 14 is absorbed and held on the transfer member 1 by the charges. The transfer medium 14 held on the transfer member 1 is conveyed to a transfer station by the rotation of the transfer member 1, and a toner image of a first color on an image bearing member 2 is transferred onto the transfer medium 14 by transfer bias applied in accordance with the timing at which the leading end of the transfer medium 14 arrives at the transfer station.

In case of the transfer of a toner image of a second color, the value of the transfer bias is changed to thereby correct the potential dropped by the toner image of the first color having been transferred to the transfer medium 14 on the transfer member 1. Such correction is also effected on third and fourth colors and transfer is effected, whereby a color image comprising toner images of four colors superposed one upon another is formed on the transfer medium 14 on the transfer member 1. After the termination of the transfer of the toner images of four colors, the transfer medium 14 has its electricity removed by DC charge or AC charge of the opposite polarity to the developers by a separation charger 7, to thereby remove the electrostatic adsorption force between the transfer medium 14 and the transfer member 1, whereafter the transfer medium 14 is separated from the transfer member 1 through a separation pawl 15. After the termination of the separating step, the transfer medium 14 is conveyed to a fixating device 9, where the color image on the transfer medium 14 is made into a permanent image by the mixing and fixation of the toner images of respective colors. On the other hand, the surface of the transfer member 1 has its electricity removed by an electricity removal charger 8 and is electrically initialized. As the electricity removal charger 8, use is made, for example, of an electrically conductive roller having an AC voltage applied thereto or an AC corona charger.

The image formation by the color image forming apparatus of the bias drum type has been described above with respect chiefly to the transferring step, but the developing step is the same as that in an apparatus of the cut-away drum type.

Now, the above-described transfer member 1 of the bias drum type is brought into contact with the image bearing member 2 in the nip portion therebetween with the image bearing member 2 given a predetermined amount of intrusion in the radial direction of the transfer member 1, and the contact pressure thereof need be minimized to prevent the void of character images caused by transfer. So, the leading end portion of the flexible sheet 1*a* covering the electrically conductive elastic layer 1*b* as viewed in the twining direction thereof is fixed to the gripperportion 11, and the flexible sheet 1*a* is not adhesively secured to the electrically conductive elastic layer 1*b*, whereby the rise of the contact pressure by deformational distortion caused by the intrusion of the image bearing member 2 is suppressed by the deviation of the flexible sheet 1*a* relative to the electrically conductive elastic layer 1*b* thereunder in the direction of the surface thereof. If for example, the flexible sheet 1*a* is adhesively secured to the electrically conductive elastic layer 1*b* over the whole surface thereof, the underlying electrically conductive elastic layer 1*b* could not escape in the direction of the surface thereof when the flexible sheet 1*a* is pressed, and the surface hardness of the transfer member 1 will heighten and the contact pressure will rise and thus, a void will be created in the image transferred.

Accordingly, in the present embodiment, the transfer member 1 having the flexible sheet 1*a* not adhesively secured to the electrically conductive elastic layer 1*b* is brought into pressure contact and is rotated. At this time, the electrically conductive elastic layer 1*b* of the transfer member 1 is temporarily crushed by the image bearing member 2 when it passes through the nip portion (here, when the transfer member 1 is at a stop, the image bearing member 2 is opposed to the grip portion 11 of the transfer member 1 and therefore, when the transfer member 1 is at a stop, the electrically conductive elastic layer 1*b* is not compressed by the image bearing member 2). The electrically conductive elastic layer 1*b* which has passed through the nip portion tries to recover its original shape. However, it takes a certain degree of time for the electrically conductive elastic layer 1*b* to completely recover its shape before the rotation of the transfer member 1 has been started and therefore, the circumferential length of the electrically conductive elastic layer 1*b* in the direction of movement of the transfer member 1 during the rotation of the transfer member 1 becomes shorter than the circumferential length of the electrically conductive elastic layer 1*b* before the transfer member 1 starts to rotate. Accordingly, a play of the flexible sheet 1*a* is necessarily created between the flexible sheet 1*a* and the electrically conductive elastic layer 1*b*, but the play is drawn by the image bearing member 2, whereby it disappears to a certain degree due to the flexible sheet 1*a* deviating on the electrically conductive elastic layer 1*b* in the direction opposite to the direction of rotation of the transfer member 1.

Also, the trailing end of the flexible sheet 1*a* is fixed to the gripper portion 11 through a spring or the like to give it a suitable degree of freedom, and the flexible sheet 1*a* liberates the accumulation of distortion created by being drawn by the image bearing member 2 or the like, whereby the flexible sheet 1*a* is prevented from being damaged. However, when the deviation which eliminates this play of the flexible sheet 1*a* occurs during image transfer, it will also influence the transfer medium 14 absorbed and held on the flexible sheet 1*a*, and the influence will appear as the shift of registration (so-called misregistration) of visible images, and this has caused the quality of printed color images to be remarkably deteriorated.

The misregistration caused by the flexible sheet 1*a* being deviated has tended to remarkably occur for the first transfer medium for which the play of the flexible sheet 1*a* is not regulated and disappear for the second and subsequent transfer mediums during continuous image formation (printing). Further, even for the first transfer medium, it has the tendency of not affecting the printing and second and third colors, and for the second and subsequent colors of the first transfer medium, it is considered that the flexible sheet 1*a* does not so greatly deviate as to affect the misregistration. Accordingly, it has been guessed that if the flexible sheet 1*a* is once deviated and the play thereof is eliminated, the flexible sheet 1*a* will always be stable in that state and the misregistration will decrease as long as the transfer member is rotated.

From such a point of view, as a countermeasure for preventing the above-noted misregistration, an attempt has been made to idly rotate the transfer member 1 a plurality of times, prior to the printing of the first transfer medium, to thereby mechanically draw the flexible sheet 1*a* by the image bearing member 2 and deviate the flexible sheet 1*a* so as to eliminate its play beforehand, but a great improvement in registration has not been obtained contrary to expectation. Also, the tendency that higher hardness of the electrically conductive elastic layer 1*b* results in a decreased amount of misregistration has been observed, and it has been found that the hardness of the electrically conductive elastic layer 1*b* promotes the play of the flexible sheet 1*b*. However, if the hardness of the electrically conductive elastic layer 1*b* is heightened, there is formed an image in which voids of characters are created, and it has been difficult to satisfy the prevention of voids and misregistration.

Figure 1:
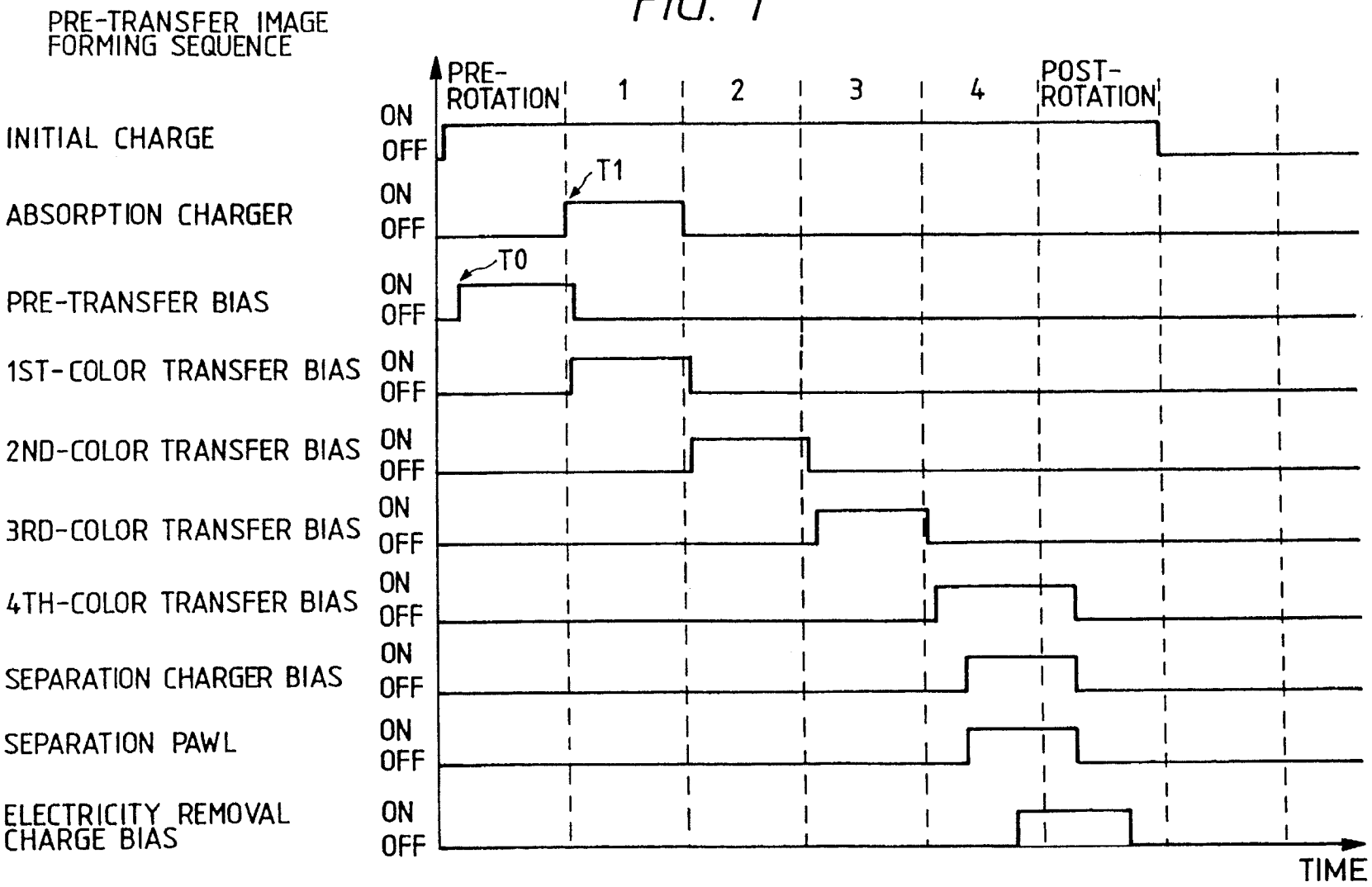
FIG. 1 shows the color image forming sequence in Embodiment 1 of the present invention.
Figure 2:
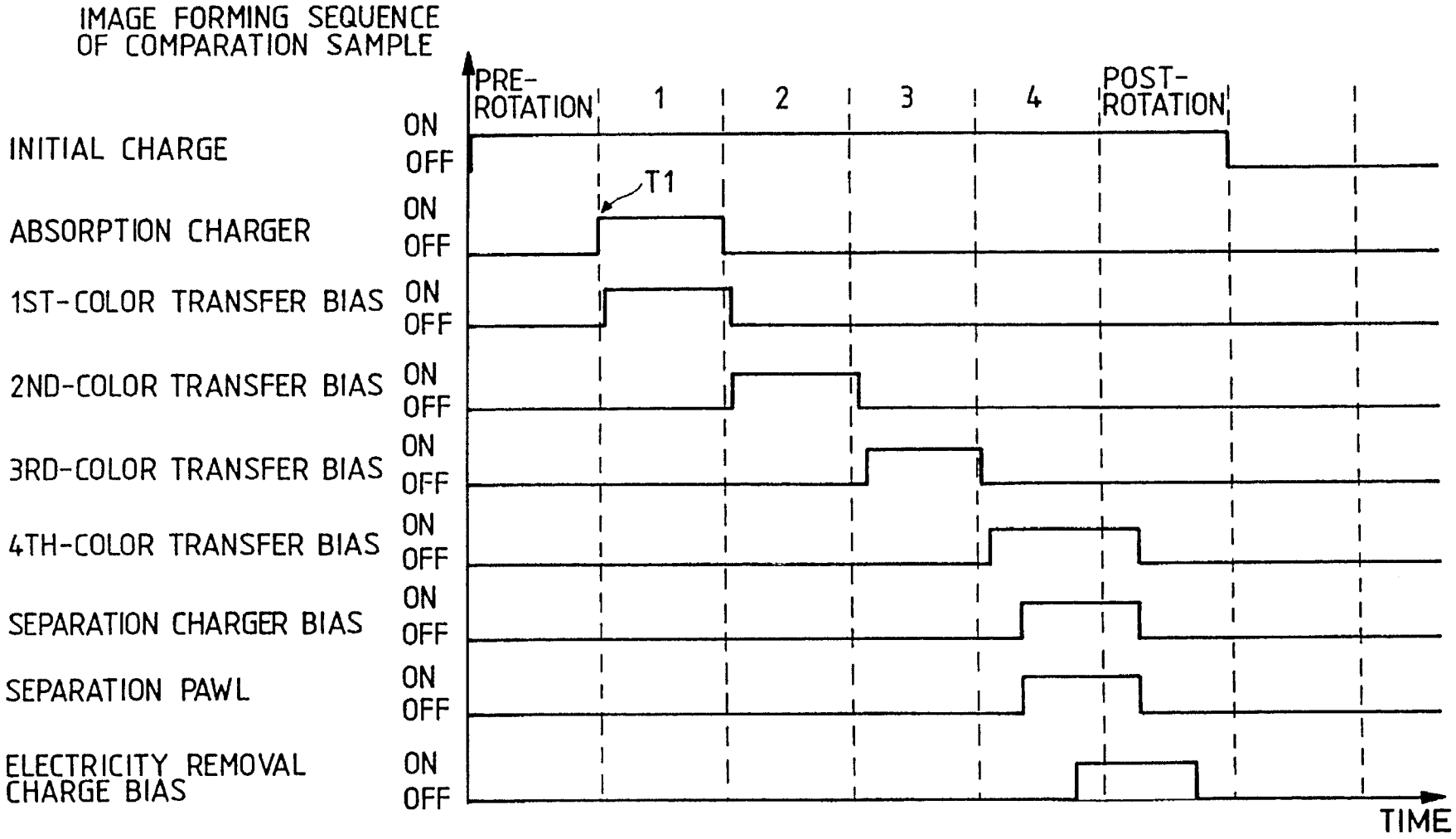
FIG. 2 shows the color image forming sequence in an image forming apparatus according to a comparative example.

So, in the present embodiment, the above-noted problem is solved by forming a color image by a sequence shown in FIG. 1. FIG. 2 shows the sequence of a comparative example having the problem of the deviation of registration.

Figure 11:
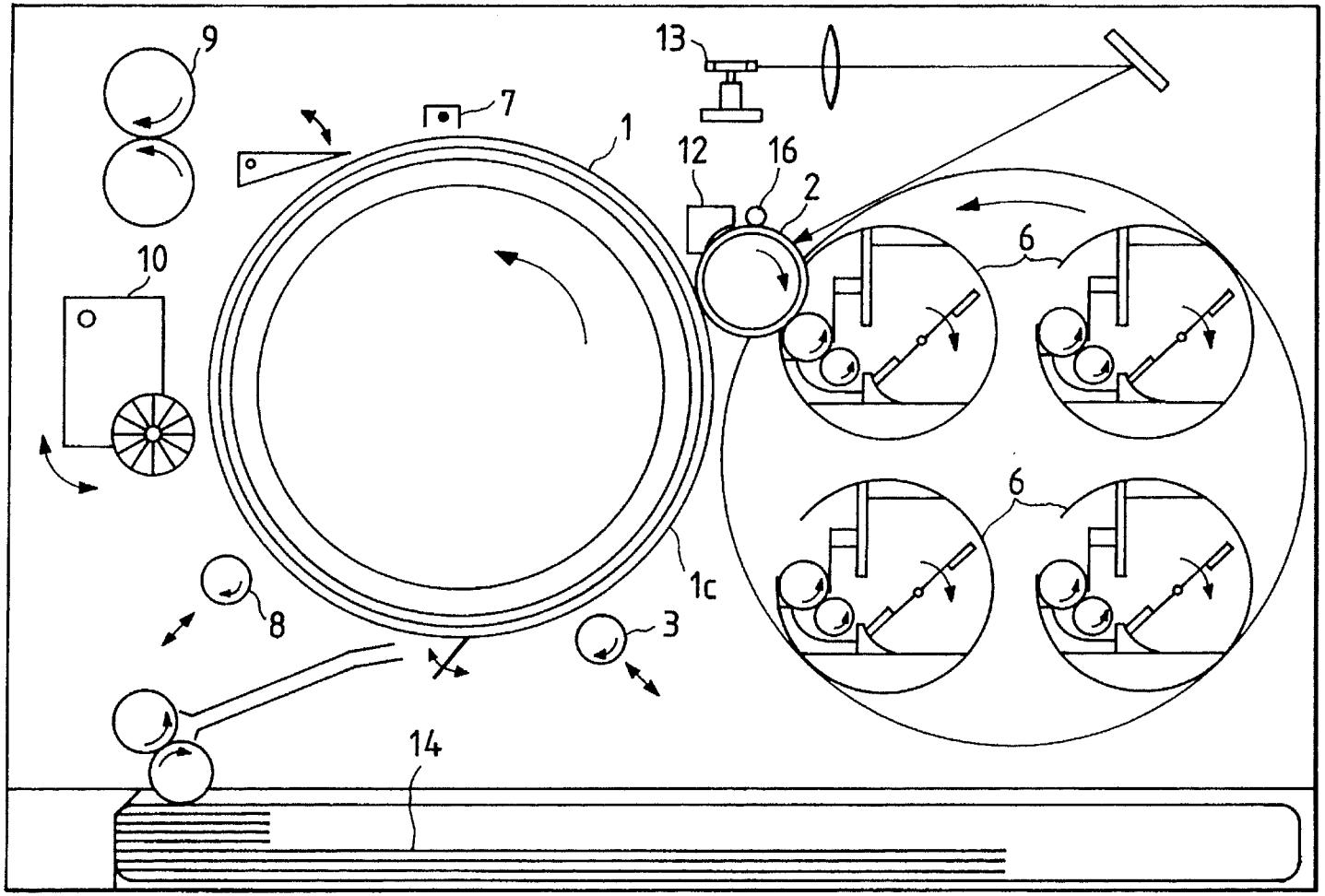
FIG. 11 shows the construction of a color image forming apparatus using a transfer member of the bias drum type.

The present embodiment is characterized in that bias is applied to the transfer member 1 of the bias drum type of the image forming apparatus shown in FIG. 11 during pre-rotation earlier than the point of time at which the transfer medium 14 is adsorbed and held on the transfer member 1.

In the present embodiment, as shown in FIG. 1, a pre-transfer bias application period has been added to the transfer bias to thereby operate the absorption roller 3 which is the absorption charger of FIG. 11, and bias has been applied to the transfer member 1 at a point of time TO earlier than timing T1 at which the transfer medium 14 is absorbed and held on the transfer member 1. That is, in the present embodiment, bias has been applied to the transfer member 1 before the leading end of the transfer medium 14 arrives at the transfer station. In the comparative example, as shown in FIG. 2, there is no bias applied to the transfer member 1 before the timing T1 at which absorption charging takes place.

By the use of the image forming apparatus of FIG. 11, color image formation has been effected in accordance with the present embodiment and the image has been outputted and the amount of misregistration has been measured, and the result is shown in Table 1 below in contrast with the result in the image forming apparatus of FIG. 2.

TABLE 1

| | sequence | amount of misregistration of 1st color | amount of misregistration of 2nd and subsequent colors |
|---|---|---|---|
| Comparative Example | FIG. 2 | 100 to 200 μm | 10 to 50 μm |
| Present Embodiment | FIG. 1 | 10 to 80 μm | 10 to 50 μm |

As shown in Table 1 above, it has been confirmed that when the sequence according to the present embodiment of FIG. 1 is used, the registration of the first color is remarkably improved. It is shown that 10 to 80 μm which is the amount of misregistration of the first color in the case of the present embodiment is a value approximate to 10 to 50 μm which is the amount of misregistration measured for the transfer member 1 in which the hardness of the electrically conductive elastic layer 1*b* has been increased and by the present embodiment, the shift caused by the play of the flexible sheet 1*a* when the first color is transferred has been regulated beforehand.

Figure 3:
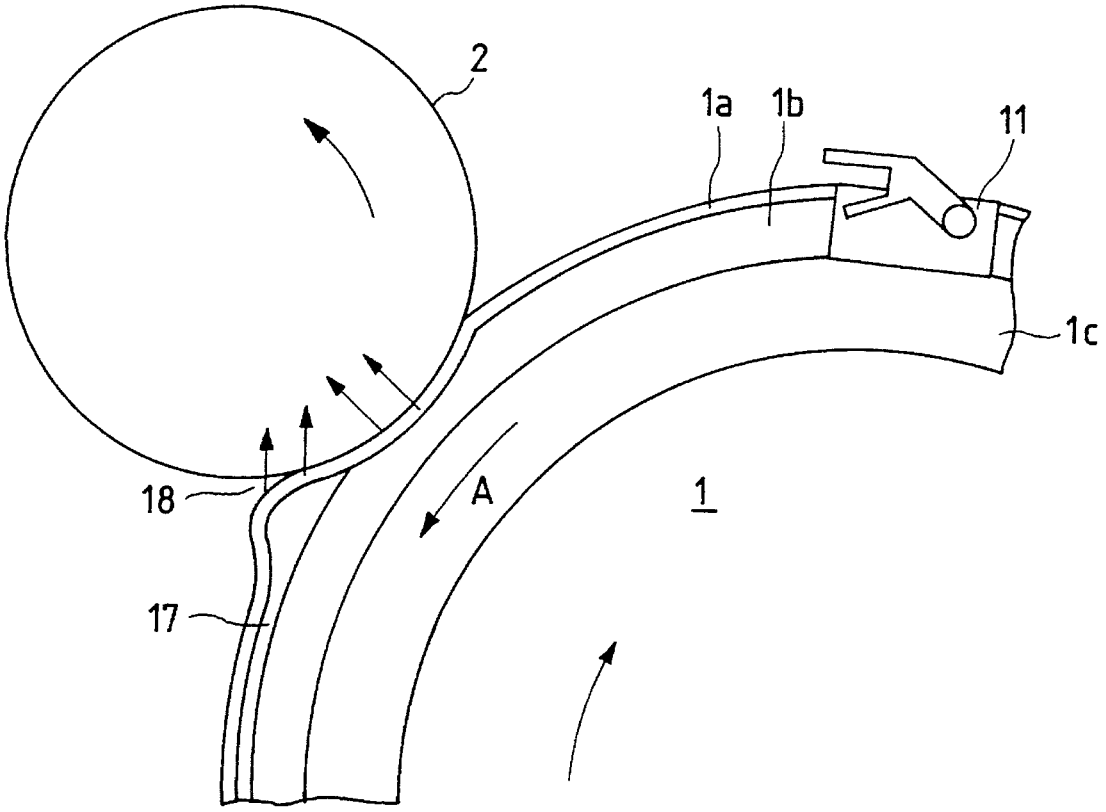
FIG. 3 illustrates the manner in which deviation occurs in the transfer portion of a transfer member installed in the image forming apparatus of FIG. 1, so as to eliminate the play of the flexible sheet of the transfer member.

A factor which gives birth to the above-noted effect in the present embodiment is that prior to the step of holding the transfer medium 14, transfer bias has applied to the transfer member 1 during pre-rotation to thereby shift the flexible sheet 1*a* beforehand and eliminate the play thereof, and the reason for this will hereinafter be described with reference to FIG. 3.

By predetermined transfer bias being applied to the transfer member 1 during its pre-rotation, a potential difference is created between the flexible sheet 1*a* of the transfer member 1 and the image bearing member 2. When the flexible sheet 1*a* passes the transfer station in which it is in pressure contact with the image bearing member 2, an electrostatic force 18 directed from the flexible sheet 1*a* toward the image bearing member 2 acts as shown in FIG. 3 and thus, the flexible sheet 1*a* comes into close contact with the image bearing member 2 and follows the movement of the image bearing member 2. However, the flexible sheet 1*a* covers the electrically conductive elastic layer 1*b* with a play 17 and therefore, by following the movement of the image bearing member 2, the flexible sheet 1*a* is subjected to a tensile force in the direction of arrow A opposite to the direction of movement thereof. Accordingly, the flexible sheet 1*a* is brought into close contact with the image bearing member with a higher close contact force than when it is mechanically drawn by the electrically conductive elastic layer 1*b*, and the play 17 is first fed to the side opposite to the transfer station and is eliminated at the tail end of the flexible sheet 1*a*.

In other words, at the stage before the transfer member 1 holds the transfer medium 14 thereon, the flexible sheet 1*a* is deviated by an electrostatic force in addition to a mechanical force so as to eliminate its play with the electrically conductive elastic layer 1*b*, whereby there is attained a state in which the flexible sheet 1*a* will never deviate thereafter. That state is maintained as long as the transfer member 1 is rotated and therefore, no misregistration will occur between the toner image of the first color and the toner images of the second and subsequent colors.

Here, it is preferable that the pre-rotation be one full rotation or more in order to compress the whole surface of the electrically conductive elastic layer 1*b*. Further, it is preferable that during this pre-rotation, i.e., during at least one full rotation, a potential difference be created between the image bearing member 2 and the flexible sheet 1*a*.

What is important in the foregoing is that the movement speed of the flexible sheet 1*a* is set so as to be substantially equal to or somewhat higher than that of the surface of the image bearing member 2. When this relation is not satisfied, that is, when the movement speed of the surface of the image bearing member 2 is higher than that of the flexible sheet 1*a*, the play of the flexible sheet 1*a* will be promoted in the transfer station and apparently the misregistration will become more serious.

In the embodiment described above, it is preferable that the value of the transfer bias applied during the pre-rotation (the pre-transfer bias) be lower than the value of the transfer bias for the first color, when it is taken into account that the transfer bias is sequentially increased during the transfer of each color. More specifically, it is good to set the value of the pre-transfer bias to a value ½–⅔ time as high as the transfer bias for the first color. The order of +300 to +1000 V is mentioned as an example of the pre-transfer bias, and when the transfer medium was directed to the transfer station with the surface charge of the flexible sheet 1*a* initialize in advance and the surface potential of the image bearing member 2 was set to about −700 V and the pre-transfer bias was set to the order of +300 to +1000 V, there was obtained a good color image free of misregistration from the first color.

Description has been made above of the construction in which the pre-transfer bias is applied to the transfer member 1, whereby deviation for eliminating the play of the flexible sheet 1*a* is created before printing, whereas the pre-transfer bias need not always be resorted to, but it will be good if the flexible sheet 1*a* can be electrostatically attracted to the image bearing member 2, and the use of a sequence as shown in an embodiment which will be described later would also result in the obtainment of a similar effect.

[Embodiment 2]

Figure 4:
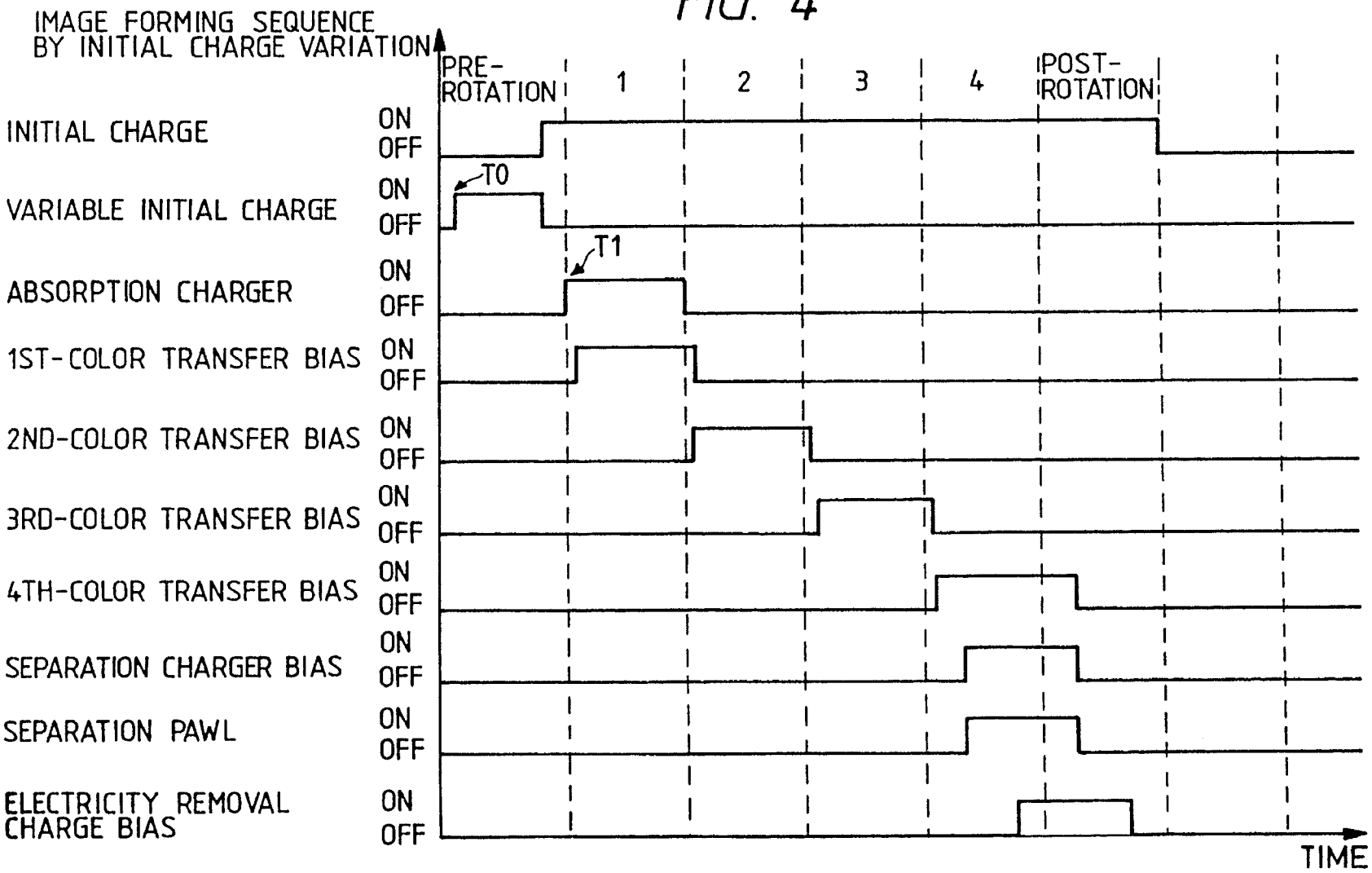
FIG. 4 shows the color image forming sequence in Embodiment 2 of the present invention.

FIG. 4 shows a sequence in Embodiment 2 of the present invention which is applicable to the apparatus described in Embodiment 1. Use is made of such a sequence in which the bias value of the initial charger 16 for uniformly charging the surface of the image bearing member 2 is varied (changed) only during the pre-rotation (variable initial charging) and in the transfer station, a greater potential difference is created between the transfer member 1 and the image bearing member 2 than during ordinary image formation. When for example, a roller charger is employed as the initial charger 16, the image bearing member 2 should be charged to −700 V in ordinary printing, but in the present embodiment, the image bearing member 2 has been charged to e.g. −1500 V only during the pre-rotation so as to make the potential difference between it and the transfer member 1 greater.

Again by such a sequence, as in the case of Embodiment 1, the flexible sheet can be deviated so as to eliminate its play with the electrically conductive elastic layer 1*b*, whereafter there is attained a state in which the flexible sheet 1*a* does not deviate, and an effect similar to that of Embodiment 1 is obtained.

[Embodiment 3]

Figure 5:
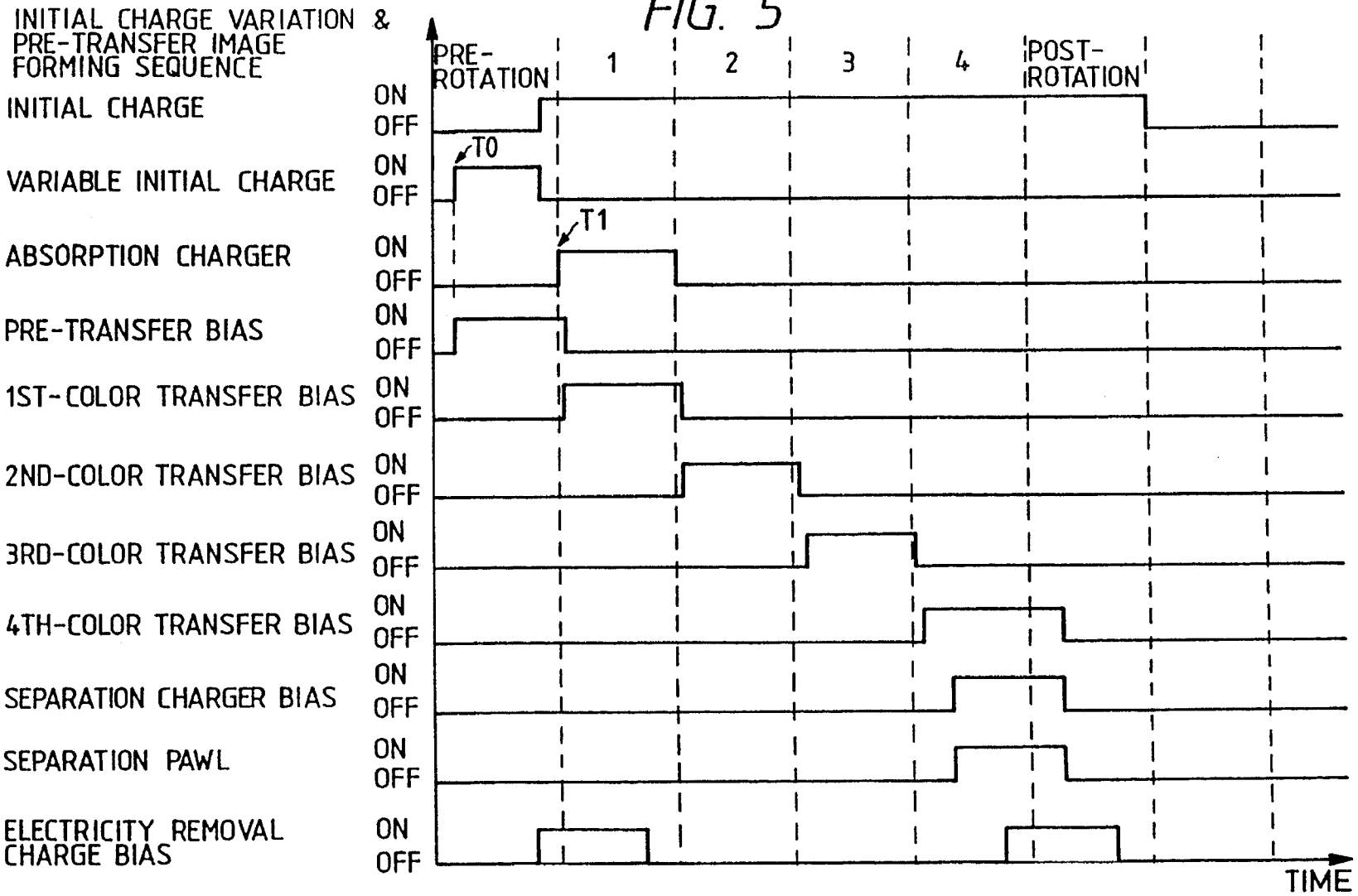
FIG. 5 shows the color image forming sequence in Embodiment 3 of the present invention.

In this embodiment, as shown in the sequence of FIG. 5, the pre-transfer bias of Embodiment 1 and the charge potential variation of the initial charge of Embodiment 2 were used in combination. An effect similar to that of Embodiment 1 could be further improved.

[Embodiment 4]

Figure 6:
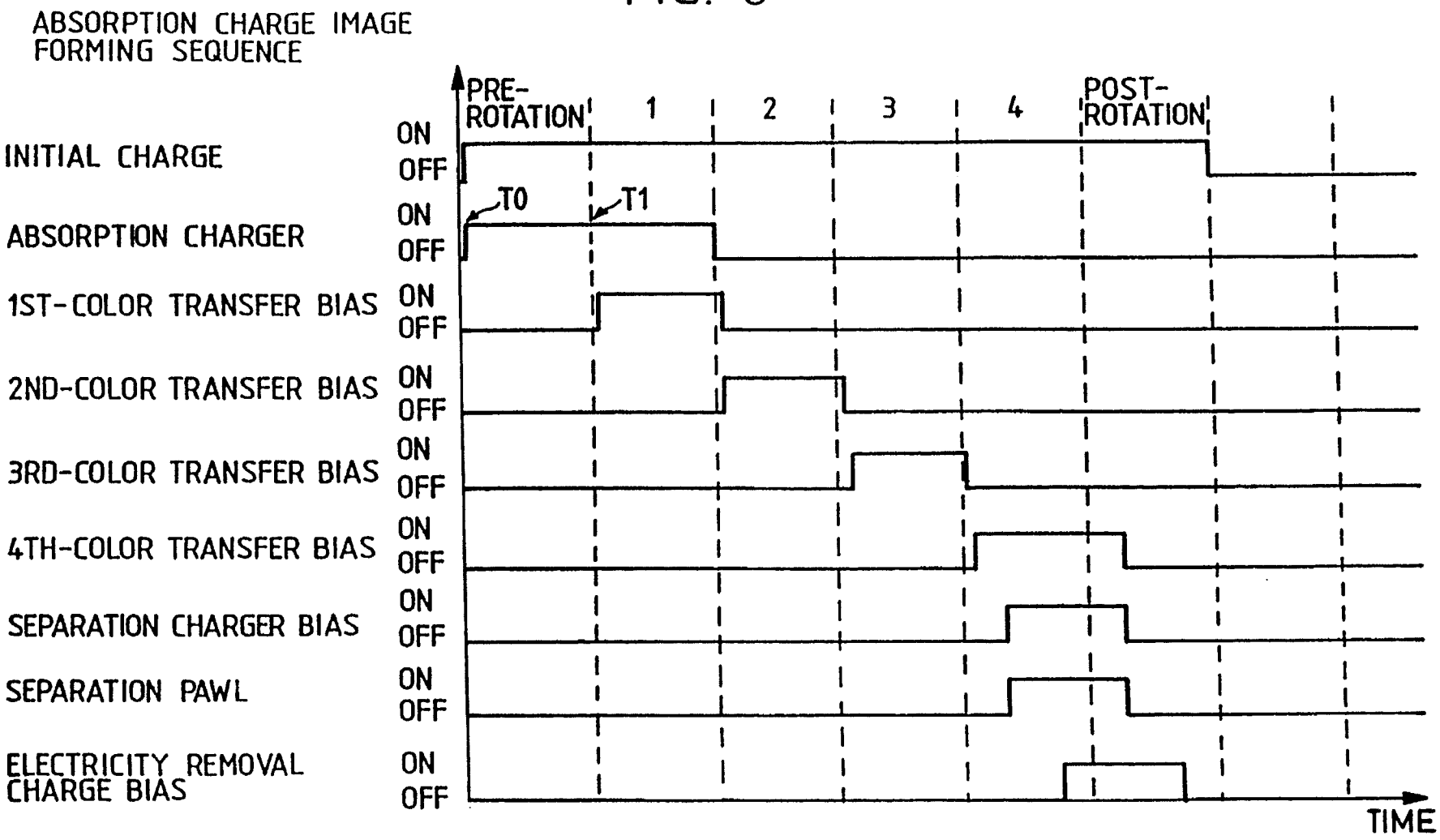
FIG. 6 shows the color image forming sequence in Embodiment 4 of the present invention.

In this embodiment applicable to the apparatus described in Embodiment 1, as shown in the sequence of FIG. 6, the surface of the flexible sheet 1*a* before the transfer medium 14 was held thereon was charged by the use of the absorption roller 3. Likewise, in the transfer station, an electrostatic absorption force can be created between the image bearing member 2 and the flexible sheet 1*a* and therefore, again by this embodiment, an effect similar to that of Embodiment 1 can be obtained.

[Embodiment 5]

Figure 7:
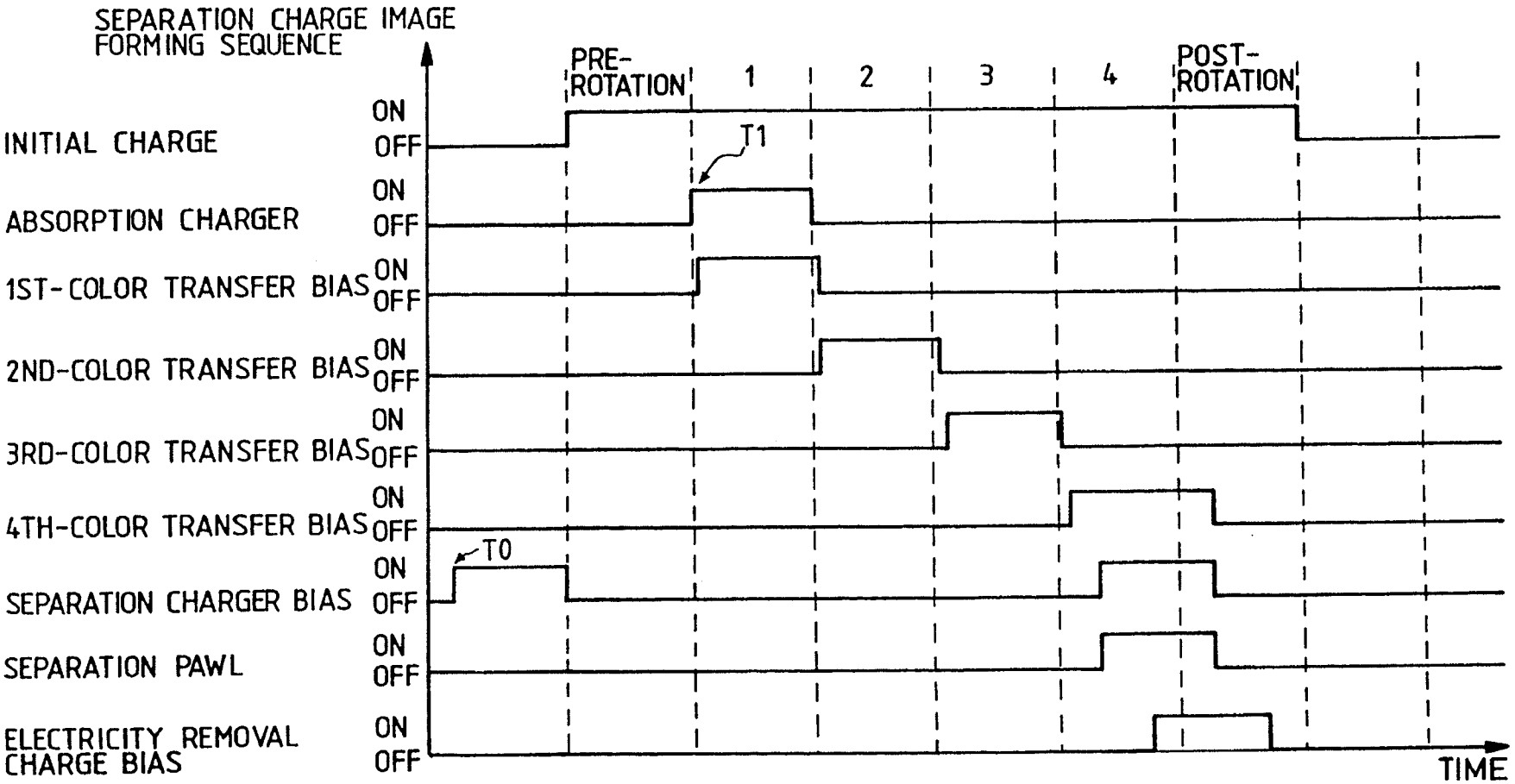
FIG. 7 shows the color image forming sequence in Embodiment 5 of the present invention.

In this embodiment applicable to the apparatus described in Embodiment 1, as shown in the sequence of FIG. 7, the surface of the flexible sheet 1*a* before the transfer medium 14 was held thereon was charged by the separation roller 7. Likewise, in the transfer station, an electrostatic absorption force can be created between the image bearing member 2 and the flexible sheet 1*a* and a similar effect can be obtained.

In Embodiments 4 and 5 above, description has been made of the sequences when the pre-transfer bias is not used, but if the pre-transfer bias is used with these as in the case of Embodiment 3, the effect will be further enhanced.

[Embodiment 6]

Figure 8:
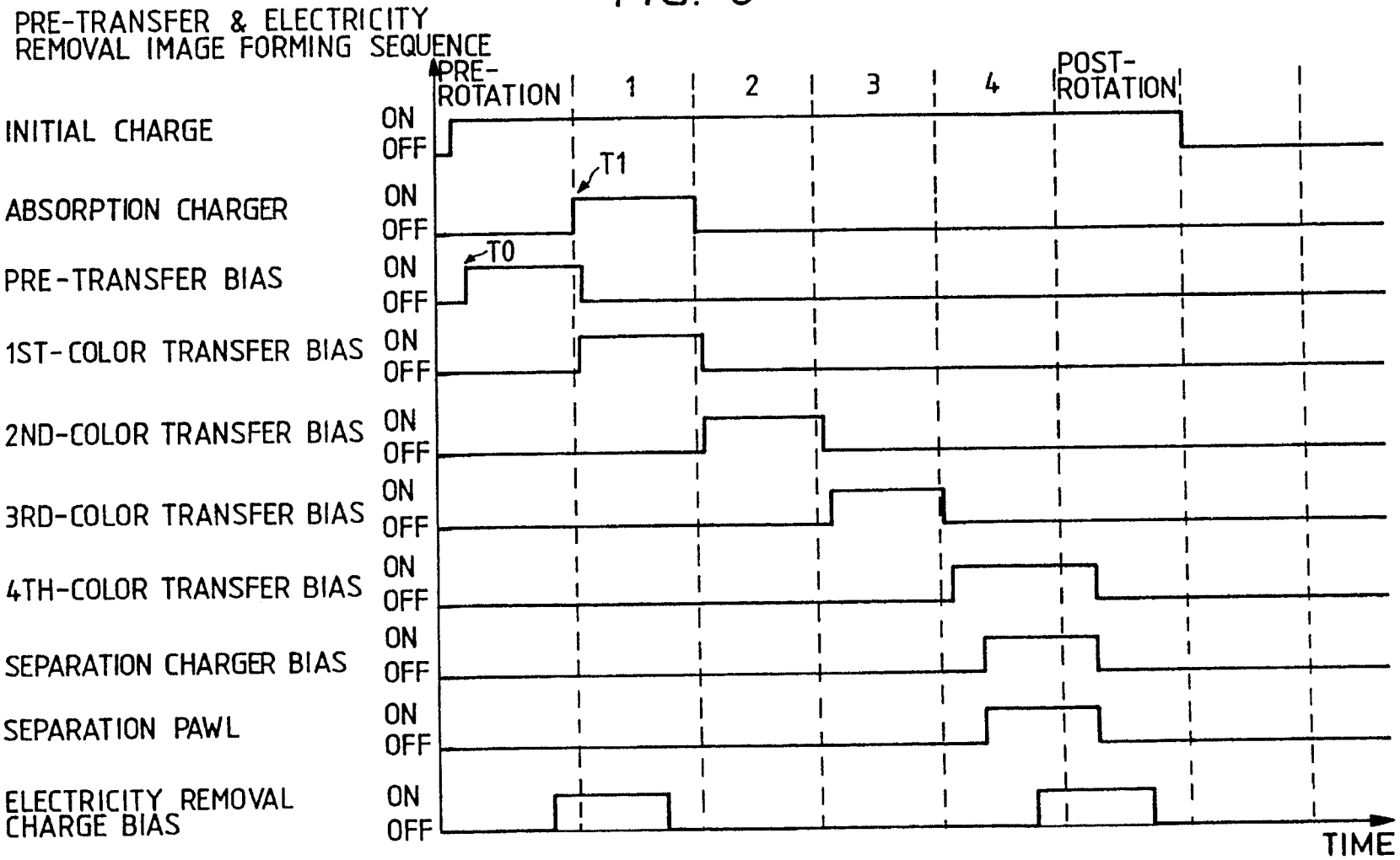
FIG. 8 shows the color image forming sequence in Embodiment 6 of the present invention.

This embodiment applicable to the apparatus described in Embodiment 1 is characterized in that as shown in the sequence of FIG. 8, the electricity removal charger 8 is also operated to apply electricity removal bias during the rotation succeeding to the pre-rotation during which the pre-transfer bias is applied. The operating time and timing of the electricity removal charger 8 are set from a point of time at which the pre-rotation period has been more or less entered, so that the portions in which the transfer member 1 to which the pre-transfer bias has been applied is brought into contact with the image bearing member 2 by the rotation thereof may have their electricity removed.

This is because the play of the flexible sheet 1*a* is decreased by the pre-transfer bias, but it may happen that the flexible sheet 1*a* is charged to the polarity opposite to that of the pre-transfer bias by the exchange of charges in the transfer station, whereby the absorption of the transfer medium 14 and the effect of the transfer bias for the first color may be spoiled. Accordingly, after the pre-transfer bias is applied and the flexible sheet 1*a* comes into contact with the image bearing member 2 and before it absorbs the transfer medium, the flexible sheet 1*a* has its electricity removed again and is initialized.

According to the present embodiment, the charge-up of the flexible sheet 1*a* before the absorption of the transfer sheet 14 which may have occurred in the other embodiments can also be prevented and printing of a high image quality suffering little from misregistration becomes possible.

Description has been made above of the method of creating deviation between the image bearing member 2 before the transfer medium holding step and the flexible sheet 1*a*, but a similar effect could be expected if in the same manner as in the above-described embodiments, a potential difference is created between that which bears against the transfer member 1 with an amount of intrusion and which itself drives and the flexible sheet 1*a*. If for example, drive is applied to the absorption roller 3 to thereby drive it independently relative to the transfer member 1 and a voltage is applied to at least one of the absorption roller 3 and the flexible sheet 1*a* to thereby create a potential difference between the absorption roller 3 and the flexible sheet 1*a*, the flexible sheet 1*a* will be attracted in the contact portion of the absorption roller 3 by the absorption roller 3 in a direction to decrease its play and will shift so as to eliminate its play and thus, an effect similar to that previously described will be obtained.

Also, in the present invention, the application timing or the bias value of the bias voltage applying means can only be changed to create a potential difference between the flexible sheet and the image bearing member or between the flexible sheet and the absorption roller, and this will never result in any increased cost and bulkiness of the apparatus.

What is claimed is:

1. An image forming apparatus comprising:

an image bearing member bearing images thereon and movable; and a transfer medium bearing member provided in pressure contact with said image bearing member and bearing a transfer medium thereon and rotatable, said transfer medium bearing member having a sheet member for bearing the transfer medium thereon, and an elastic layer supporting that area of said sheet member bearing the transfer medium thereon from the inside of said sheet member, a voltage being applied to said transfer medium bearing member to transfer the images on said image bearing member to the transfer medium born on said sheet member;

wherein said sheet member having an area not fixed to said elastic layer, said transfer medium bearing member being rotated with a potential difference created between said image bearing member and said sheet member before the operation of transferring the images on said image bearing member to the transfer medium born on said sheet member is started.

2. An image forming apparatus according to claim 1, wherein the images on said image bearing member are successively superposed one upon another and transferred to the transfer medium born on said sheet member.

3. An image forming apparatus according to claim 2, wherein said transfer medium bearing member is caused to make at least one full rotation with said potential difference created.

4. An image forming apparatus according to claim 2, wherein said potential difference is created before the leading end of the transfer medium born on said sheet member arrives at a transfer position whereat the images on said image bearing member are transferred to the transfer medium.

5. An image forming apparatus according to claim 4, wherein said potential difference is created before the transfer medium is born on said transfer medium bearing member.

6. An image forming apparatus according to claim 2, wherein a voltage is applied to said transfer medium bearing member to create said potential difference.

7. An image forming apparatus according to claim 1, wherein a voltage is applied to said transfer medium bearing member to create said potential difference.

8. An image forming apparatus according to claim 3, wherein a voltage is applied to said transfer medium bearing member to create said potential difference.

9. An image forming apparatus according to claim 4, wherein a voltage is applied to said transfer medium bearing member to create said potential difference.

10. An image forming apparatus according to claim 5, wherein a voltage is applied to said transfer medium bearing member to create said potential difference.

11. An image forming apparatus according to claim 1, wherein a movement speed of said sheet member and a movement speed of said image bearing member are equal to each other.

12. An image forming apparatus according to claim 2, wherein a movement speed of said sheet member and a movement speed of said image bearing member are equal to each other.

13. An image forming apparatus according to claim 3, wherein a movement speed of said sheet member and a movement speed of said image bearing member are equal to each other.

14. An image forming apparatus according to claim 4, wherein a movement speed of said sheet member and a movement speed of said image bearing member are equal to each other.

15. An image forming apparatus according to claim 5, wherein a movement speed of said sheet member and a movement speed of said image bearing member are equal to each other.

16. An image forming apparatus according to claim 6, wherein a movement speed of said sheet member and a movement speed of said image bearing member are equal to each other.

17. An image forming apparatus according to claim 1, wherein a movement speed of said sheet member is higher than a movement speed of said image bearing member.

18. An image forming apparatus according to claim 2, wherein a movement speed of said sheet member is higher than a movement speed of said image bearing member.

19. An image forming apparatus according to claim 3, wherein a movement speed of said sheet member is higher than a movement speed of said image bearing member.

20. An image forming apparatus according to claim 4, wherein a movement speed of said sheet member is higher than a movement speed of said image bearing member.

21. An image forming apparatus according to claim 5, wherein a movement speed of said sheet member is higher than a movement speed of said image bearing member.

22. An image forming apparatus according to claim 6, wherein a movement speed of said sheet member is higher than a movement speed of said image bearing member.

23. An image forming apparatus according to claim 6, provided with a charger for charging said image bearing member and wherein said charger charges said image bearing member to create said potential difference.

24. An image forming apparatus according to claim 6, wherein the voltage applied to said transfer medium bearing member to create said potential difference before the start of the image transfer to the transfer medium born on said sheet member is smaller than the voltage applied to said transfer medium bearing member when the images are transferred to the transfer medium born on said sheet member.

25. An image forming apparatus according to claim 1, wherein said transfer medium bearing member is provided with a supporting portion for supporting the leading end portion and trailing end portion of said sheet member with respect to the direction of movement of said transfer medium bearing member.

26. An image forming apparatus according to claim 2, wherein said transfer medium bearing member is provided with a supporting portion for supporting the leading end portion and trailing end portion of said sheet member with respect to the direction of movement of said transfer medium bearing member.

27. An image forming apparatus according to claim 3, wherein said transfer medium bearing member is provided with a supporting portion for supporting the leading end portion and trailing end portion of said sheet member with respect to the direction of movement of said transfer medium bearing member.

28. An image forming apparatus according to claim 4, wherein said transfer medium bearing member is provided with a supporting portion for supporting the leading end portion and trailing end portion of said sheet member with respect to the direction of movement of said transfer medium bearing member.

29. An image forming apparatus according to claim 5, wherein said transfer medium bearing member is provided with a supporting portion for supporting the leading end portion and trailing end portion of said sheet member with respect to the direction of movement of said transfer medium bearing member.

30. An image forming apparatus according to claim 6, wherein said transfer medium bearing member is provided with a supporting portion for supporting the leading end portion and trailing end portion of said sheet member with respect to the direction of movement of said transfer medium bearing member.

31. An image forming apparatus according to claim 1, wherein the trailing end portion of said sheet member is fixed to a supporting portion through an elastic member expandable and contractible in the direction of movement of said sheet member.

32. An image forming apparatus according to claim 2, wherein the trailing end portion of said sheet member is fixed to a supporting portion through an elastic member expandable and contractible in the direction of movement of said sheet member.

33. An image forming apparatus according to claim 3, wherein the trailing end portion of said sheet member is fixed to a supporting portion through an elastic member expandable and contractible in the direction of movement of said sheet member.

34. An image forming apparatus according to claim 4, wherein the trailing end portion of said sheet member is fixed to a supporting portion through an elastic member expandable and contractible in the direction of movement of said sheet member.

35. An image forming apparatus according to claim 5, wherein the trailing end portion of said sheet member is fixed to a supporting portion through an elastic member expandable and contractible in the direction of movement of said sheet member.

36. An image forming apparatus according to claim 6, wherein the trailing end portion of said sheet member is fixed to a supporting portion through an elastic member expandable and contractible in the direction of movement of said sheet member.

37. An image forming apparatus according to claim 1, wherein said sheet member is not fixed to said elastic layer.

38. An image forming apparatus according to claim 2, wherein said sheet member is not fixed to said elastic layer.

39. An image forming apparatus according to claim 3, wherein said sheet member is not fixed to said elastic layer.

40. An image forming apparatus according to claim 4, wherein said sheet member is not fixed to said elastic layer.

41. An image forming apparatus according to claim 5, wherein said sheet member is not fixed to said elastic layer.

42. An image forming apparatus according to claim 6, wherein said sheet member is not fixed to said elastic layer.

43. An image forming apparatus according to claim 1, provided with a charger for charging said image bearing member and wherein in order to create said potential difference, said charger imparts to said image bearing member charges more than an amount of charge imparted to said image bearing member when an image is formed on said image bearing member.

44. An image forming apparatus according to claim 2, provided with a charger for charging said image bearing member and wherein in order to create said potential difference, said charger imparts to said image bearing member charges more than an amount of charge imparted to said image bearing member when an image is formed on said image bearing member.

45. An image forming apparatus according to claim 3, provided with a charger for charging said image bearing member and wherein in order to create said potential difference, said charger imparts to said image bearing member charges more than an amount of charge imparted to said image bearing member when an image is formed on said image bearing member.

46. An image forming apparatus according to claim 4, provided with a charger for charging said image bearing member and wherein in order to create said potential difference, said charger imparts to said image bearing member charges more than an amount of charge imparted to said image bearing member when an image is formed on said image bearing member.

47. An image forming apparatus according to claim 5, provided with a charger for charging said image bearing member and wherein in order to create said potential difference, said charger imparts to said image bearing member charges more than an amount of charge imparted to said image bearing member when an image is formed on said image bearing member.

48. An image forming apparatus according to claim 6, provided with a charger for charging said image bearing member and wherein in order to create said potential difference, said charger imparts to said image bearing member charges more than an amount of charge imparted to said image bearing member when an image is formed on said image bearing member.

49. An image forming apparatus according to claim 1, provided with absorption means for imparting charges to said sheet member to absorb the transfer medium to said sheet member and wherein in order to create said potential difference, said absorption means imparts charges to said sheet member.

50. An image forming apparatus according to claim 2, provided with absorption means for imparting charges to said sheet member to absorb the transfer medium to said sheet member and wherein in order to create said potential difference, said absorption means imparts charges to said sheet member.

51. An image forming apparatus according to claim 3, provided with absorption means for imparting charges to said sheet member to absorb the transfer medium to said sheet member and wherein in order to create said potential difference, said absorption means imparts charges to said sheet member.

52. An image forming apparatus according to claim 4, provided with absorption means for imparting charges to said sheet member to absorb the transfer medium to said sheet member and wherein in order to create said potential difference, said absorption means imparts charges to said sheet member.

53. An image forming apparatus according to claim 5, provided with absorption means for imparting charges to said sheet member to absorb the transfer medium to said sheet member and wherein in order to create said potential difference, said absorption means imparts charges to said sheet member.

54. An image forming apparatus according to claim 6, provided with absorption means for imparting charges to said sheet member to absorb the transfer medium to said sheet member and wherein in order to create said potential difference, said absorption means imparts charges to said sheet member.

55. An image forming apparatus according to claim 1, provided with a charger provided on the transfer medium bearing surface side of said sheet member for charging said sheet member and wherein in order to create said potential difference, said charger charges said sheet member.

56. An image forming apparatus according to claim 2, provided with a charger provided on the transfer medium bearing surface side of said sheet member for charging said sheet member and wherein in order to create said potential difference, said charger charges said sheet member.

57. An image forming apparatus according to claim 3, provided with a charger provided on the transfer medium bearing surface side of said sheet member for charging said sheet member and wherein in order to create said potential difference, said charger charges said sheet member.

58. An image forming apparatus according to claim 4, provided with a charger provided on the transfer medium bearing surface side of said sheet member for charging said sheet member and wherein in order to create said potential difference, said charger charges said sheet member.

59. An image forming apparatus according to claim 5, provided with a charger provided on the transfer medium bearing surface side of said sheet member for charging said sheet member and wherein in order to create said potential difference, said charger charges said sheet member.

60. An image forming apparatus according to claim 6, provided with a charger provided on the transfer medium bearing surface side of said sheet member for charging said sheet member and wherein in order to create said potential difference, said charger charges said sheet member.

61. An image forming apparatus according to claim 1, wherein said transfer medium bearing member is provided with a base body to which a voltage is applied, and the elastic layer is provided between said base body and said sheet member.

62. An image forming apparatus according to claim 2, wherein said transfer medium bearing member is provided with a base body to which a voltage is applied, and the elastic layer is provided between said base body and said sheet member.

63. An image forming apparatus according to claim 3, wherein said transfer medium bearing member is provided with a base body to which a voltage is applied, and the elastic layer is provided between said base body and said sheet member.

64. An image forming apparatus according to claim 4, wherein said transfer medium bearing member is provided with a base body to which a voltage is applied, and the elastic layer is provided between said base body and said sheet member.

65. An image forming apparatus according to claim 5, wherein said transfer medium bearing member is provided with a base body to which a voltage is applied, and the elastic layer is provided between said base body and said sheet member.

66. An image forming apparatus according to claim 6, wherein said transfer medium bearing member is provided with a base body to which a voltage is applied, and the elastic layer is provided between said base body and said sheet member.

67. An image forming apparatus comprising:

an image bearing member bearing images thereon and movable;

a transfer medium bearing member provided in pressure contact with said image bearing member and bearing a transfer medium thereon and rotatable, said transfer medium bearing member having a sheet member for bearing the transfer medium thereon, and an elastic layer supporting that area of said sheet member which carries the transfer medium thereon from the inside of said sheet member, a voltage being applied to said transfer medium bearing member to transfer the images on said image bearing member to the transfer medium born on said sheet member; and a pressing member provided in pressure contact with said transfer medium bearing member;

wherein said sheet member having an area not fixed to said elastic layer, said transfer medium bearing member being rotated with a potential difference created between said pressing member and said sheet member before the operation of transferring the images on said image bearing member to the transfer medium carried on said sheet member is started.

68. An image forming apparatus according to claim 67, wherein the images on said image bearing member are successively superposed one upon another and transferred to the transfer medium born on said sheet member.

69. An image forming apparatus according to claim 67, wherein said pressing member is a rotatable member.

70. An image forming apparatus according to claim 68, wherein said pressing member is a rotatable member.

71. An image forming apparatus according to claim 67, wherein said pressing member is an absorbing rotatable member for imparting charges to said sheet member to absorb the transfer medium to said sheet member.

72. An image forming apparatus according to claim 68, wherein said pressing member is an absorbing rotatable member for imparting charges to said sheet member to absorb the transfer medium to said sheet member.

73. An image forming apparatus according to claim 67, wherein said potential difference is created before the transfer medium is born on said transfer medium bearing member.

74. An image forming apparatus according to claim 68, wherein said potential difference is created before the transfer medium is born on said transfer medium bearing member.

75. An image forming apparatus according to claim 67, wherein said image bearing member is driven independently relative to said transfer medium bearing member.

76. An image forming apparatus according to claim 68, wherein said image bearing member is driven independently relative to said transfer medium bearing member.

* * * * *

UNITED STATES PATENT AND TRADEMARK OFFICE

CERTIFICATE OF CORRECTION

PATENT NO. : 5,600,423

DATED : February 4, 1997

INVENTOR(S) : Toshiaki MIYASHIRO, et al.

It is certified that error appears in the above-indentified patent and that said Letters Patent is hereby corrected as shown below:

In the drawings:

FIGURE 2

In the title of the chart, "COMPARATION" should read --COMPARATIVE--.

COLUMN 1

Line 44, "polyuethane" should read --polyurethane--.

COLUMN 2

Line 47, "are" should read --is--.

COLUMN 5

Line 8, "need" should read --needs--;

Line 11, "gripperportion" should read --gripper portion--.

UNITED STATES PATENT AND TRADEMARK OFFICE

CERTIFICATE OF CORRECTION

PATENT NO. : 5,600,423

DATED : February 4, 1997

INVENTOR(S) : Toshiaki MIYASHIRO, et al.

It is certified that error appears in the above-indentified patent and that said Letters Patent is hereby corrected as shown below:

COLUMN 7

Line 26, "has" should read --has been--.

Signed and Sealed this

Twenty-second Day of July, 1997

Bruce Lehman

*Attest:*

BRUCE LEHMAN

*Attesting Officer*

*Commissioner of Patents and Trademarks*